US009474981B1

(12) United States Patent
Forti

(10) Patent No.: US 9,474,981 B1
(45) Date of Patent: Oct. 25, 2016

(54) MANUALLY ACTUATED PLUSH TOY WITH MOOD CHANGE

(71) Applicant: William Mark Corporation, Claremont, CA (US)

(72) Inventor: William Mark Forti, Claremont, CA (US)

(73) Assignee: William Mark Corporation, Claremont, CA (US)

( * ) Notice: Subject to any disclaimer, the term of this patent is extended or adjusted under 35 U.S.C. 154(b) by 0 days.

(21) Appl. No.: 14/935,360

(22) Filed: Nov. 6, 2015

(51) Int. Cl.

| | |
|---|---|
| ***A63H 3/20*** | (2006.01) |
| ***A63H 3/36*** | (2006.01) |
| ***A63H 3/00*** | (2006.01) |
| ***A63H 3/02*** | (2006.01) |

(52) U.S. Cl.
CPC ..... *A63H 3/365* (2013.01); *A63H 3/006* (2013.01); *A63H 3/02* (2013.01)

(58) Field of Classification Search
CPC ..... A63H 3/20; A63H 3/38; A63H 3/40; A63H 3/48
See application file for complete search history.

(56) References Cited

U.S. PATENT DOCUMENTS

| | | | | | |
|---|---|---|---|---|---|
| 962,154 | A | | 6/1910 | Lemon | |
| 2,000,242 | A | | 5/1935 | Manning | |
| 2,633,670 | A | | 4/1953 | Steuber | |
| 4,177,589 | A | * | 12/1979 | Villa | A63H 3/28 40/416 |
| 4,843,497 | A | | 6/1989 | Leyden | |
| 5,021,878 | A | * | 6/1991 | Lang | B25J 15/0009 348/211.2 |
| 5,074,821 | A | | 12/1991 | McKeefery | |
| 5,700,178 | A | | 12/1997 | Cimerman | |
| 6,053,798 | A | * | 4/2000 | Tang | A47G 33/06 446/300 |
| 6,149,490 | A | * | 11/2000 | Hampton | A63H 3/28 446/298 |
| 6,503,123 | B2 | * | 1/2003 | Chung | A63H 3/20 446/330 |
| 6,793,553 | B2 | * | 9/2004 | Willett | A63H 3/40 446/301 |
| 6,988,928 | B2 | | 1/2006 | Willett | |
| 7,234,989 | B2 | * | 6/2007 | Maddocks | A63H 3/42 446/343 |
| 7,641,535 | B2 | * | 1/2010 | Maddocks | A63H 3/38 446/342 |
| 2001/0046829 | A1 | * | 11/2001 | Chung | A63H 3/20 446/353 |
| 2002/0019193 | A1 | * | 2/2002 | Maggiore | A63H 3/48 446/337 |
| 2005/0059319 | A1 | * | 3/2005 | Patton | A63H 3/48 446/330 |
| 2006/0270312 | A1 | * | 11/2006 | Maddocks | A63H 3/28 446/337 |
| 2008/0293324 | A1 | * | 11/2008 | Friedland | A63H 3/20 446/297 |
| 2013/0288565 | A1 | * | 10/2013 | McMullen | A63H 3/365 446/321 |

FOREIGN PATENT DOCUMENTS

| | | | |
|---|---|---|---|
| GB | 14922 | | 0/1910 |
| GB | 383614 | | 2/1931 |
| JP | 2001239068 | A * | 9/2001 |
| JP | 2003230770 | A * | 8/2003 |
| JP | 2003265869 | A * | 9/2003 |

* cited by examiner

*Primary Examiner* — Michael Dennis
*Assistant Examiner* — Urszula M Cegielnik
(74) *Attorney, Agent, or Firm* — Fish & Tsang LLP

(57) ABSTRACT

A toy having changing facial features. Upon using the toy, its facial features change from a first configuration that appears "nice" to a second configuration that appears "mean" or "scary" in a way that is designed to cause an emotional reaction in a person that sees the change. To cause the change, an activator engages the transmission such that the transmission causes the eye features of the toy to rotate and the mouth to open in a coordinated fashion.

9 Claims, 5 Drawing Sheets

MANUALLY ACTUATED PLUSH TOY WITH MOOD CHANGE

FIELD OF THE INVENTION

The field of the invention is toys, more specifically toys with changing facial features.

BACKGROUND

Efforts have been made in the past to develop toys that have realistic facial expressions, but those efforts have all fallen short when it comes to creating a toy that can change its expression from "nice" to "mean." For example, in U.S. Pat. No. 5,074,821 to McKeefery et al., an attempt was made to create a toy having eyes that move in coordination with a mouth, but the eyes are caused to move in a natural way in coordination with each other. This patent fails to contemplate causing eye features to move "unnaturally" to obtain a particular facial expression.

U.S. Pat. No. 6,988,928 to Willett also attempts to create a toy that includes coordinated movements, but the Willett patent also fails to contemplate the implementation of an "unnatural" eye movement to create a particular facial expression.

Thus, there is still a need for improved toys that change facial expressions.

SUMMARY OF THE INVENTION

In one aspect of the inventive subject matter, the inventors contemplate a toy (e.g., a plush toy) having facial features that change from "nice" to "mean" when a person uses the toy. The toy preferably includes a head portion that has a mouth feature and a pair of eye features (e.g., eyes and/or eyebrows). The toy includes a motion coordinator within head portion. The motion coordinator has an activator and it couples to the mouth feature and to the pair of eye features. The motion coordinator is designed to coordinatedly cause the mouth to open and to cause the pair of eye features to rotate about axes that substantially align with lines of vision corresponding to each eye corresponding to the pair of eye features.

In some embodiments, the activator is an electromechanical button, while in other embodiments the activator is a mechanical mechanism (e.g., a push-button). Preferably, the activator is disposed within the toy but is nevertheless usable from the exterior of the toy (e.g., by pinching or applying pressure to the activator, which is located near the back of the toy's head). In any event, the activator is preferably coupled to a transmission. The transmission can include a set of gears, a rack and pinion, or even a belt and pulley. In some embodiments, the transmission even includes a pneumatic reservoir. The transmission is used to cause the eye features and the mouth to move. In preferred embodiments, the transmission causes the pair of eye features to rotate in opposite directions to make the toy appear to transition from "nice" to "mean."

The transmission component can be created in a variety of ways, but ultimately, it needs to be capable of causing the mouth to open and the eye features to rotate. In preferred embodiments, the transmission couples to an activator, the activator is coupled to a rack, and a pinion is fixed to a rod which is also coupled to the rack. The rod is then coupled to the pair of eye features and to the mouth such that the rod causes the pair of eye features to rotate about each eye's corresponding visual axis while coordinatedly causing the mouth to open. The activator is once again preferably disposed within the toy though preferably usable from the exterior of the toy (e.g., by applying a pressure to the activator, which can be located inside the toy near the back of the toy's head).

In some embodiments, the rod is coupled to the eye features via a pulley, while in others it is coupled to the eye features via one or more gears. Regardless of how the rod is coupled to the eye features, the eye features of preferred embodiments are caused to rotate in opposite directions about each corresponding eye's visual axis.

In one further aspect of the inventive subject matter, the inventors contemplate a method of producing an emotional change in a person using a toy. The method steps preferably include (1) providing the toy having a set of facial features moveable between a first and a second position, where the facial features include a set of eye brows and a mouth, and (2) actuating a mechanism. Actuating the mechanism causes rotation of the eye brows about a visual axis of each corresponding eye from a position where the eyebrows are angling upward toward the center of the toy's face to a position where the eyebrows are angling downward toward the center of the toy's face. While the eyes rotate, the mouth coordinatedly opens. By undergoing these feature shifts, the facial expression of the toy changes from "nice" to "mean" or "scary." The stark contrast in expression causes the emotional change in a person from a positive affect to a negative affect (e.g., from calm, relaxed, or inquisitive to surprise, fright, or amusement, etc.). The mechanism is preferably disposed within the toy and usable from the exterior of the toy.

In some embodiments, the first facial features include a closed mouth with the eyebrows angling upward toward the center of the toy's face, while the second facial features comprise an open mouth with the eyebrows angling downward toward the center of the toy's face. In still further embodiments, the set of eye features include light sources that activate upon rotation to the position angling downward to enhance the desired emotional change. The facial features of preferred embodiments also revert automatically back to the first facial features from the second facial features (e.g., by spring force, by pneumatic force).

BRIEF DESCRIPTION

DETAILED DESCRIPTION

Figure 1B:
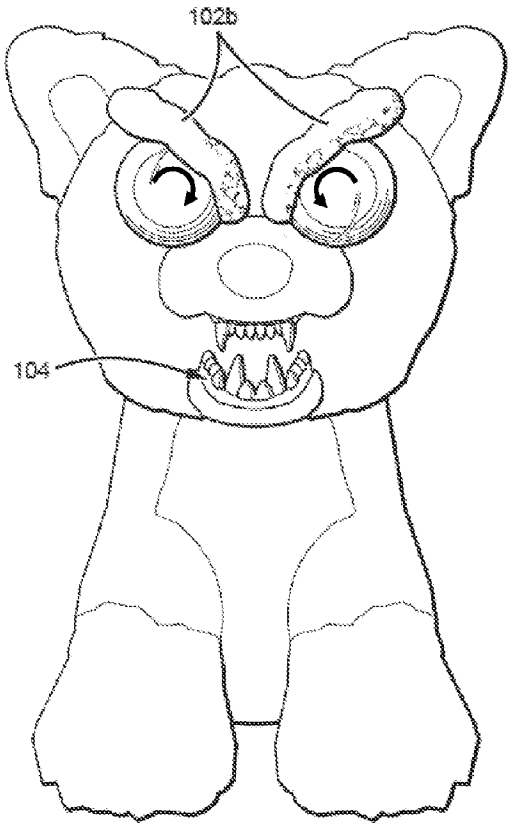
FIG. 1B shows an embodiment of the toy with a "mean" face.
Figure 1A:
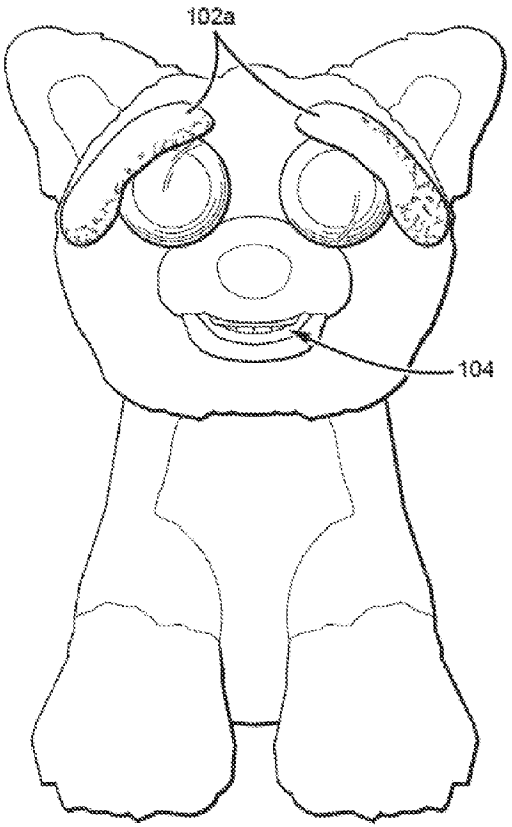
FIG. 1A shows an embodiment of the toy with a "nice" face.

The inventive subject matter of this application revolves around systems and methods of toys having changeable facial expressions. Essentially, the toys incorporate three key components: eye features, a mouth, and a motion coordinator. These toys—which can be plush toys that look like, for example, small dogs, rabbits, cats, people, and even customized to resemble recognizable people or friends—incorporate the motion coordinator within an interior portion of the toy, such as the head. Pressure can be applied to the motion coordinator from the exterior of the toy (e.g., by squeezing the back of the head or neck), which causes coordinated movement between the eyes and the mouth. As seen in FIGS. 1A and 1B, this coordinated movement includes the rotation of the eye features 102*a* (e.g., eyebrows) from a position where they are angling upward toward the center of the face to a position where they are angling downward toward the center of the face (see 102*b*), while also causing the mouth feature 104 to open. The end result is a "nice" face as seen in FIG. 1A changing into a "mean" face as seen in FIG. 1B. In preferred embodiments, the "mean" face springs back to the "nice" face automatically (e.g., using a spring). The eye features of the toy can include eyes, eyebrows, or both. In some embodiments, the eyes and eyebrows are fixed to each other, while in other embodiments, the eyes and eyebrows are separate, discrete parts.

Figure 2:
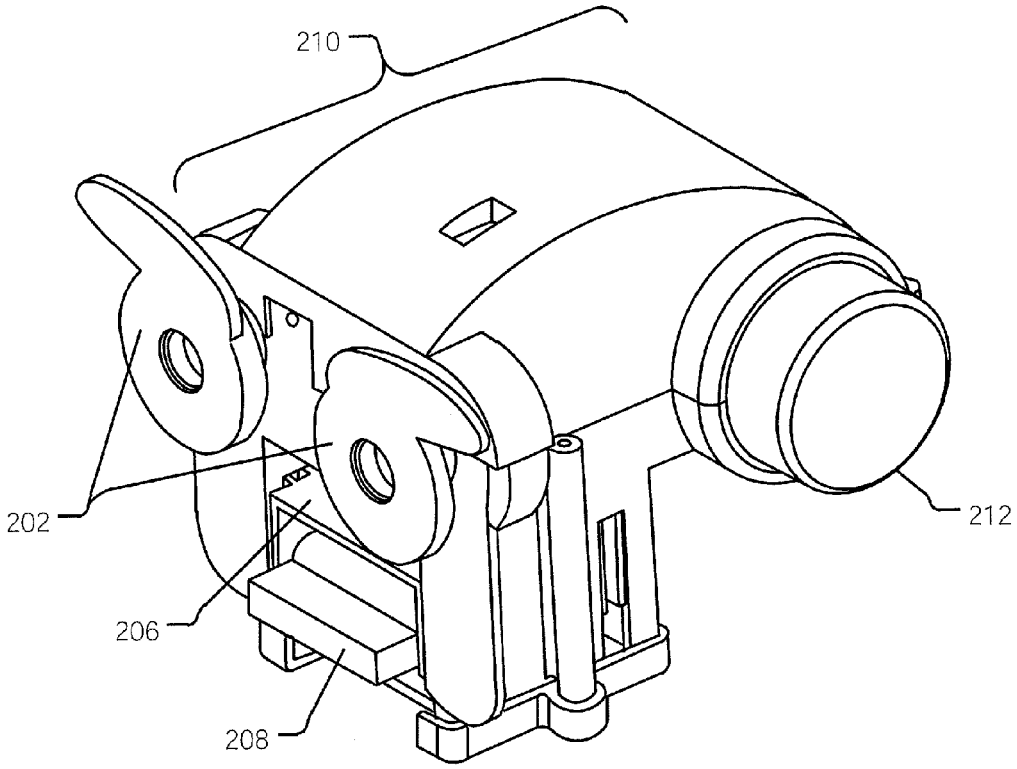
FIG. 2 shows an assembled view of the components that make up the toy.

FIGS. 2-5 show different views of an embodiment of the mechanical components that are integral to the functions of the toy. FIG. 2 shows the mechanical components when they are fully assembled. The eye features 202 in this embodiment are made up of eyebrows that are fixed to the eyes (e.g., they are formed from the same material), but in some embodiments, the eyebrows can move independently from the eyes (e.g., they are formed as separate components). Preferably, only the eye features 202 would be visible on an assembled toy, with the rest of the components disposed inside the toy.

Each eye feature 202 is coupled to an eye feature shaft 204, which cause the eye features 202 to rotate. The eye feature shafts 204 can couple to the eye features 202 in different locations to affect where the axis of rotation is relative to the center of each eye. This can produce different effects when the eye features 202 rotate. For example, in an embodiment where the eyes and the eyebrows are fixed to each other, the eye feature shafts 204 can be coupled to the eye features 202 off center from the centers of each eye in such a way that the eye features 202 rotate to be closer together as the eyebrow angles change from upward toward center to downward toward center (e.g., changing from "nice" to "mean").

Critically, the eye features 202 rotate in opposite directions such that the eyebrows change angles as shown in across FIGS. 1A and 1B. To do this, eye feature 202 rotation occurs along an axis that is preferably parallel to the visual axis of each corresponding eye. In some embodiments, each eye feature 202 rotates about a visual axis 228, 230 (e.g., an axis normal to the center of an eye and passing through a pupil of the eye), but in other embodiments eye feature 202 rotation can occur about different axes to produce different effects. In embodiments where the eye features rotate about the visual axes of corresponding eyes 228, 230, the axis of rotation and the visual axis need only be substantially aligned (e.g., distance between the visual axis and the axis of rotation should be within 0-1%, 1-2%, 0-5%, 5-10%, 10-15%, 15-20% of the radius of the eye).

For example, in some embodiments only the eyebrows rotate. In those embodiments, the axis of rotation can be selected such that the eyebrows cover a different surface area of the eyes depending on their position. The effect of making the toy appear "mean" can be enhanced by having more of the eye covered by the eyebrow as the eyebrows turn to angle downward toward the center of the toy's face. To achieve this effect, the axis of rotation for the eye features 202 can be located off of the visual axis 228, 230 for each corresponding eye. For example, in some embodiments, the eyebrows can be positioned to leave all the eyes visible when the toy is in the "nice" configuration, but when it changes to "mean" the eyebrows rotate to partially cover portions of the eyes, thereby enhancing the effect.

The mouth feature 104, as demonstrated in FIGS. 1A and 1B, can also be seen in FIGS. 2-5. When transitioning from "nice" to "mean," not only do the eye features 202 rotate, but the mouth of the mouth feature 206 & 208 opens as well. In preferred embodiments, the eye features 202 rotate and the mouth feature 206 & 208 opens in a coordinated fashion (e.g., the mouth opens as the eyes rotate).

In some embodiments, the mouth feature 206 & 208 includes a movable top pallet 206 and a moveable lower jaw 208, though in others it includes only a movable lower jaw 208 with a fixed top pallet 206. In embodiments with a movable top pallet 206, the top pallet 206 of the mouth lowers upon activation to reveal top teeth while the lower jaw 208 opens to reveal bottom teeth. In other embodiments, the top pallet 206 is fixed allowing only the lower jaw 208 to open upon activation. Baring the top teeth can also be achieved by including a component that raises the upper lip of the toy instead of lowering the top pallet 206. In still further embodiments, the toy can additionally include a tongue that sticks out as the lower jaw 208 opens. In some embodiments, the mouth feature does not include an opening jaw (or any moving jaw pieces) instead having only a tongue that sticks out upon activation of the motion coordinator. Timing for the mouth feature 206 & 208 can be adjusted to have the mouth open quickly or slowly relative to rotation of the eye features 202.

As mentioned above, the eye features 202 and the mouth feature are caused to move by a motion coordinator 210. The motion coordinator 210 is characterized by an activator 212 and a transmission 214. The activator 212 receives an input (e.g., a button press, a squeeze, etc.), which causes the transmission 214 to rotate the eye features 202 and open the mouth feature.

In preferred embodiments, such as the embodiment shown in FIGS. 2-5, the activator 212 is a set of opposing mechanical push buttons. The push buttons are each coupled to a rack, which are further coupled to opposite sides of a pinion gear fixed to a shaft. When the push buttons are pressed (e.g., by squeezing the back of a toy), the racks cause the pinion gear to rotate, which in turn causes the eye features 202 to rotate and the mouth feature to open as described above.

In other embodiments, the activator 212 can alternatively be an electromechanical button that causes activation of an electronic motor or other actuator that causes the eye features 202 to rotate and the mouth feature to open. The activator 212 could also be pneumatic or hydraulic, depending on the construction of the motion coordinator 210. Beyond specific examples, the inventors contemplate that the activator 212 could be any kind of device that receives a mechanical input (e.g., a finger press or squeeze).

In still further embodiments, the activator could be located externally to the toy (e.g., in the nose, in an eye, on the face, or on the front of the toy's body) and include a light sensor, motion sensor, or even a camera. In embodiments where the activator includes a light sensor, the toy can be programmed to, for example, change to its "mean" face when the lights are out, and back to the "nice" face when the lights are on. To enhance this effect, the eyes of the toy can additionally include light sources that can make the eyes light up red when the "mean" face is active. When the activator includes a motion sensor, the toy can be programmed to change from a "nice" face to a "mean" face when people are moving in front of its face. The change can occur when the toy detects movement within a range of distances (0-2 ft, 2-4 ft, 4-6 ft, 6-8 ft, and 8-10 ft). To help determine distance, the toy can optionally include a component that detects how close objects are to the toy (such as an acoustic range finder). Finally, in toys implementing a camera, the toy can be programmed to change from the "nice" face to the "mean" face, for example, if it detects a person has just entered a room or if it detects that a person is looking at the toy's face.

In still further embodiments, the toy can include a speaker as well as various lights. In embodiments with a speaker, the speaker can be used to enhance both the "nice" effect and the "mean" effect. For example, when the face is in the "nice" configuration, the speaker can make a purring sound, while in the mean configuration, the speaker can make a growling sound. It is not required that these effects accompany one another. In embodiments having lights, the lights can be placed on the toy in places to enhance both the "nice" effect and the "mean" effect. For example, lights could be placed in the eyes of the toy such that, when the toy's expression changes from "nice" to "mean," its eyes light up. The lights can be various colors, such as red, white, or blue. In another example, the eyes could light up blue, white, or some combination of blue and white when the toy's expression is "nice."

The transmission 214 enables coordinated movement between the eye features 202 and the mouth feature. For purposes of this application, a transmission is a machine that comprises of a power source (e.g., the activator) and a power transmission system (e.g., the gears and related components), which provides controlled application of the power.

In the embodiment shown in FIGS. 2-5, it is gear driven, implementing a number of rack and pinion gears in conjunction with other gears to ultimately transfer mechanical energy from the activator to the eye features 202 and the mouth feature. Other gear types that could be used include: spur, helical, skew gears, double helical, bevel, spiral bevels, hypoid, crown, worm, non-circular, epicyclic, sun and planet, harmonic gears, cage gears, and magnetic gears.

Other modes of transferring energy from the activator to the eye features 202 and the mouth feature are also contemplated. For example, the transmission 214 can be pulley driven instead of gear driven, or it can operate using a combination of electromechanical buttons (e.g., activators) with solenoids that cause the eye features 202 to rotate and the mouth feature to open.

Figure 3:
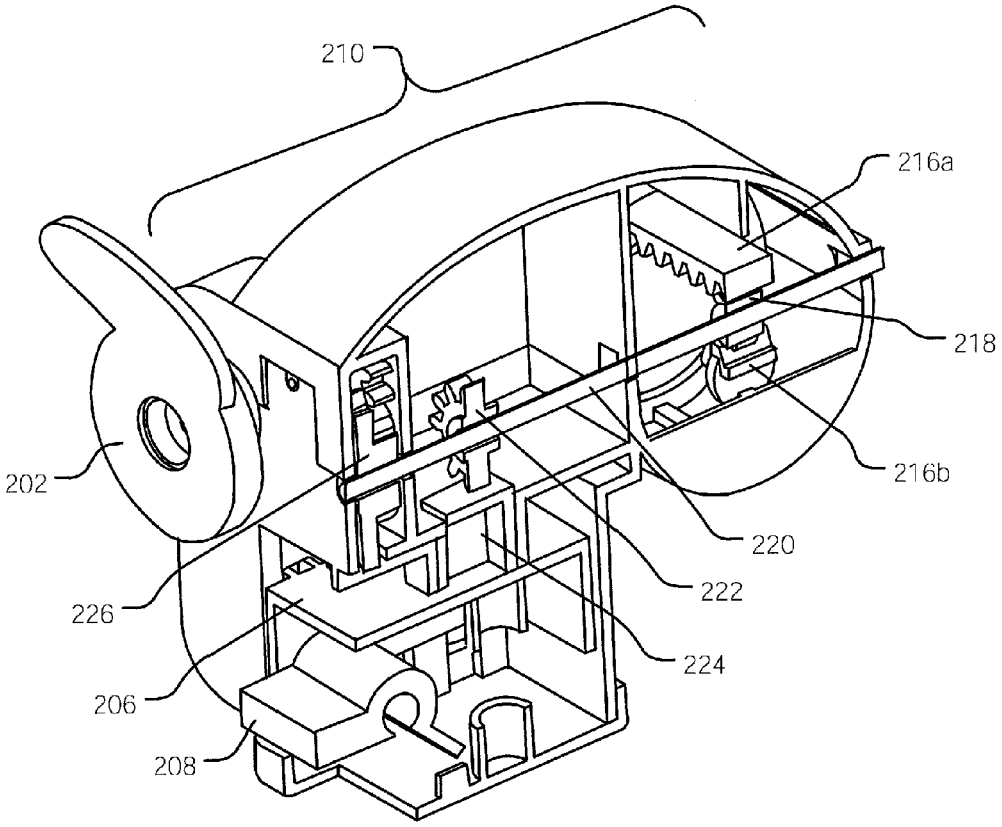
FIG. 3 shows a cutaway view of the components that make up the toy.
Figure 4:
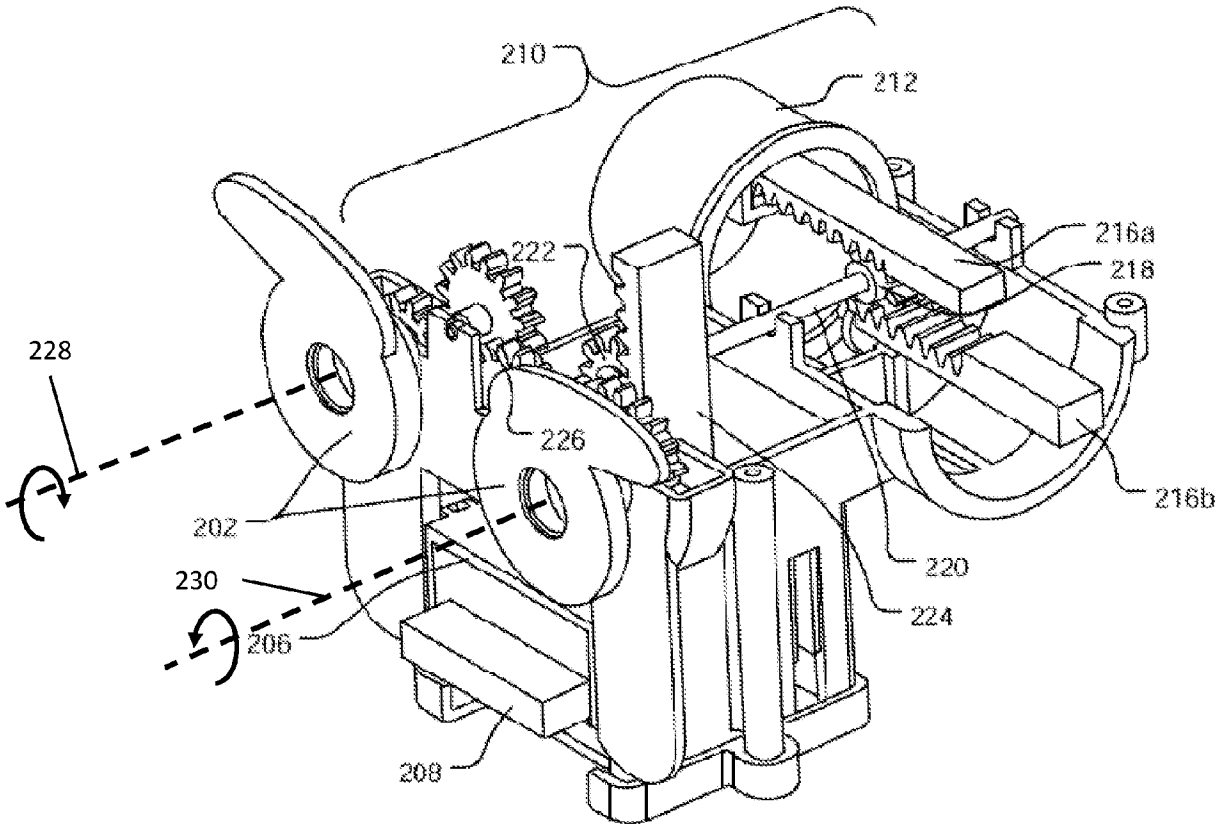
FIG. 4 shows an alternative cutaway view of the components that make up the toy.
Figure 5:
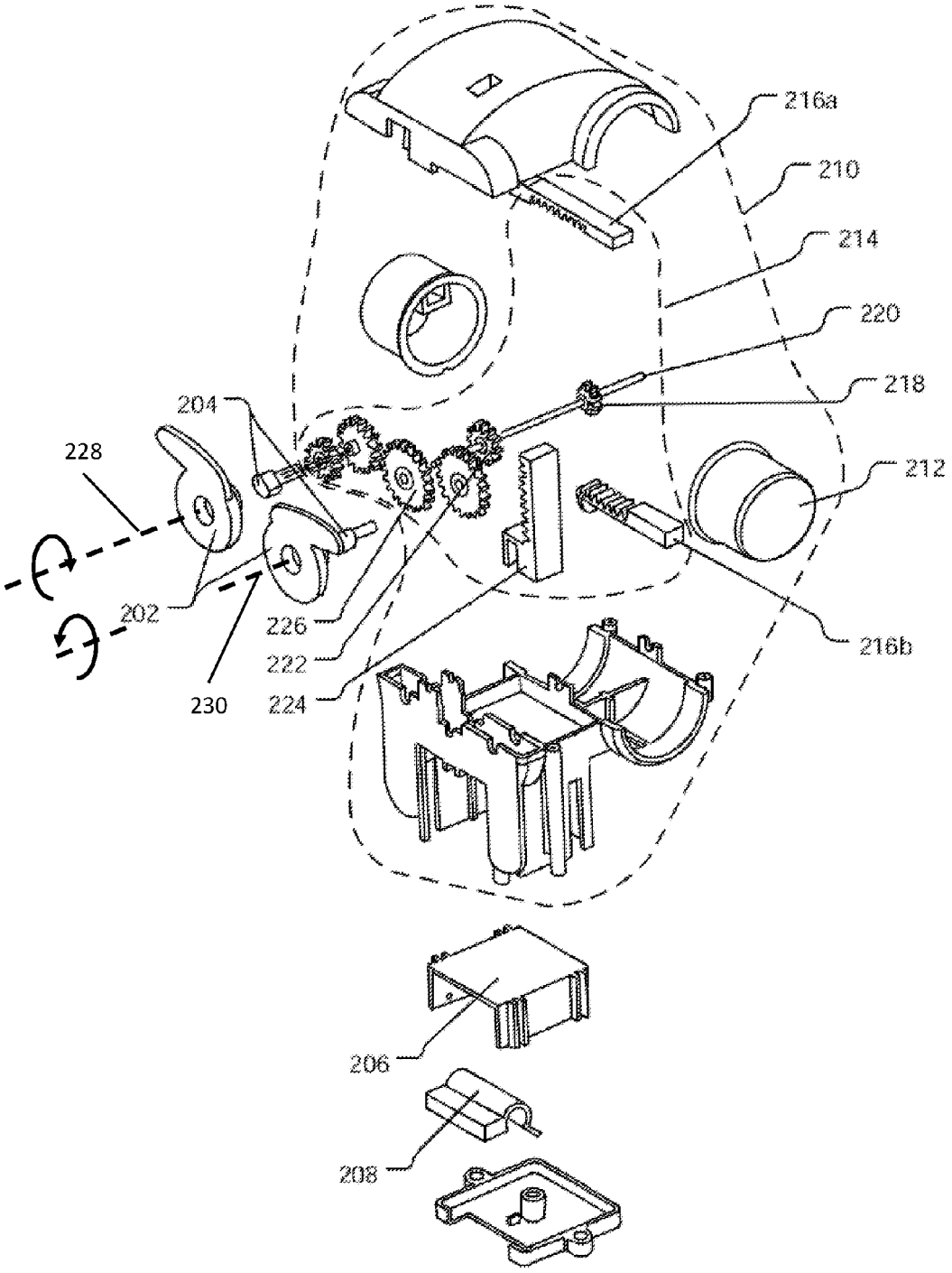
FIG. 5 shows an exploded view of the components that make up the toy.

In some embodiments, it can be preferable for the transmission 214 to be a hybrid of a number of different transmission 214 types. For example, the transmission 214 could include a rack and pinion coupled to the activator as shown in FIGS. 3-5, but instead of having gears to transfer mechanical energy to the eye features 202, it could instead include one or more pulleys. In other embodiments, the activator could be an electromechanical button that causes a small electronic motor to turn a gear, a pulley, or some combination of the two.

In one example of the toy, a user must depress or squeeze two activators 212, which in turn pushes two racks 216*a* & 216*b* that rotate an associated pinion gear 218. The pinion gear 218 rotates a rod 220, which in turn rotates a number of other gears that are fixed to the rod 220. One of the other gears 222 causes another rack 224 to move downward to open the mouth feature 206 & 208, while another gear 226 on the rod 220 causes the eye features 202 to rotate in opposite directions at the same time that the mouth feature 206 & 208 opens.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as," etc.) provided with respect to certain embodiments herein is intended merely to better illuminate the invention and does not pose a limitation on the scope of the invention otherwise claimed. No language in the specification should be construed as indicating any non-claimed element essential to the practice of the invention.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts in this application. The inventive subject matter, therefore, is not to be restricted except in the spirit of the appended claims. Moreover, in interpreting both the specification and the claims, all terms should be interpreted in the broadest possible manner consistent with the context.

The invention claimed is:

1. A toy comprising:

a head portion comprising a mouth feature and a pair of eye features;

a motion coordinator disposed at least partially within the head portion;

the motion coordinator coupled to the mouth feature and to the pair of eye features, wherein the motion coordinator comprises an activator;

wherein the motion coordinator is configured to coordinatedly cause, upon actuation of the activator, and via a transmission acting upon respective eye feature shafts to which the eyes are coupled, (1) the pair of eye features to rotate about axes that are substantially aligned with lines of vision corresponding to each eye of the pair of eye features and (2) the mouth to open;

wherein the pair of eye features rotate in opposite directions from a first to a second position; and wherein the motion coordinator is further configured to automatically revert the eyes from the second to the first position and to close the mouth.

2. The toy of claim 1, wherein the activator comprises an electro-mechanical button.

3. The toy of claim 1, wherein the activator is coupled to a transmission.

4. The toy of claim 3, wherein the transmission comprises a set of gears.

5. The toy of claim 4, wherein the set of gears comprises at least one rack and at least one pinion.

6. The toy of claim 3, wherein the transmission comprises at least one belt and at least one pulley.

7. The toy of claim 3, wherein the transmission comprises a pneumatic reservoir.

8. The toy of claim 1, wherein the pair of eye features each comprise an eyeball and eyebrow.

9. The toy of claim 1, wherein the activator is disposed within the toy and usable from the exterior of the toy.

* * * * *